US007818942B2

(12) United States Patent
Nakamitsu et al.

(10) Patent No.: US 7,818,942 B2
(45) Date of Patent: Oct. 26, 2010

(54) METHOD OF BUILDING A FLOOR FOR A BOILER CAGE

(75) Inventors: Kazuhito Nakamitsu, Tokyo (JP); Shigeyoshi Kawaguchi, Tokyo (JP); Shinichirou Takeshita, Tokyo (JP); Yuusuke Yoshida, Tokyo (JP); Yuuji Yokoi, Tokyo (JP); Hiromi Itagaki, Kure (JP); Shoji Shinohara, Kure (JP); Kenshin Komatsu, Kure (JP)

(73) Assignees: Hitachi Plant Technologies, Ltd., Tokyo (JP); Babcock-Hitachi Kabushiki Kaisya, Tokyo (JP)

( * ) Notice: Subject to any disclaimer, the term of this patent is extended or adjusted under 35 U.S.C. 154(b) by 600 days.

(21) Appl. No.: 11/831,547

(22) Filed: Jul. 31, 2007

(65) Prior Publication Data

US 2008/0028723 A1 Feb. 7, 2008

(30) Foreign Application Priority Data

Aug. 3, 2006 (JP) ..... 2006-212384

(51) Int. Cl.
*E04G 21/00* (2006.01)

(52) U.S. Cl. ..... 52/745.01; 52/745.03; 52/125.1; 52/126.5; 52/745.05; 254/89 R

(58) Field of Classification Search ..... 248/68.1; 376/438, 462; 122/510; 29/890.051, 890.03, 29/897.3; 414/10, 11; 254/1, 89 R, 93 L, 254/99, 124; 52/234, 745.2, 741.1, 745.05, 52/745.06, 125.1, 126.1, 126.5, 745.1, 745.03
See application file for complete search history.

(56) References Cited

U.S. PATENT DOCUMENTS 2,686,420 A * 8/1954 Youtz ..... 52/125.1
2,758,467 A * 8/1956 Gilbert et al. ..... 52/125.1
2,867,111 A * 1/1959 Youtz ..... 52/125.1
2,964,143 A * 12/1960 Fayeton ..... 52/745.13
3,028,707 A * 4/1962 Sagalovitch ..... 52/745.13
3,052,449 A * 9/1962 Long et al. ..... 254/89 R
3,053,015 A * 9/1962 Graham ..... 52/745.13
3,239,990 A * 3/1966 Adler ..... 52/745.04
3,522,931 A * 8/1970 Von Heidenstam ..... 254/89 R
3,579,935 A * 5/1971 Regan et al. ..... 52/125.1
3,822,522 A * 7/1974 Termohlen et al. ..... 52/745.04

(Continued)

FOREIGN PATENT DOCUMENTS

JP 2932818 B 8/1993

(Continued)

*Primary Examiner*—Robert J Canfield
*Assistant Examiner*—Brent W Herring
(74) *Attorney, Agent, or Firm*—Oliff & Berridge, PLC

(57) ABSTRACT

The floor, which became a block, can easily be attached to the designated floor position, so that the reduction of both the construction cost and the construction period are achieved. It is a method of building the plural floors on the part of the boiler cage part, and one floor 13A is built on a lifting frame 18 put on the ground, and the floor 13A and the lifting frame 18 are both jacked up by jacks 14. Subsequently the lifting frame 18 which separated the floor 13A is jacking down and returned to the ground. Plural floors are built for lower floor from upper floor one after another by repeating such a series of steps.

10 Claims, 9 Drawing Sheets

U.S. PATENT DOCUMENTS 3,863,418 A * 2/1975 Faucheux ..... 52/745.04
3,974,618 A * 8/1976 Cortina ..... 52/745.14
4,251,974 A * 2/1981 Vanderklaauw ..... 52/745.2
5,469,684 A * 11/1995 Franklin ..... 52/745.13
5,577,362 A * 11/1996 Yamashita et al. ..... 52/745.03
5,644,893 A * 7/1997 Neighbours ..... 52/745.19
5,839,239 A * 11/1998 Jang ..... 52/123.1
5,970,680 A * 10/1999 Powers ..... 52/745.05
6,082,058 A * 7/2000 Deng ..... 52/125.1
2008/0016805 A1 * 1/2008 Walter ..... 52/263

FOREIGN PATENT DOCUMENTS

WO WO 2004057122 A1 * 7/2004

* cited by examiner

METHOD OF BUILDING A FLOOR FOR A BOILER CAGE

RELATED APPLICATION

The present application claims priority under the Paris Convention from Japanese Application 2006-212384 filed on Aug. 3, 2006, the contents of which are hereby incorporated by reference into this application.

BACKGROUND

1. Field of the Invention

The present invention relates to a method of a boiler cage floors and more specifically to a method of the construction of boiler cage floors that is preferred for the construction of a large-sized boiler for thermal power plant.

2. Related Art

FIG. 9 is a side view illustrating main constitution of a large-sized boiler for thermal power generator. A boiler frame 2 taking main body of a boiler 1 is the gigantic structure that bearing height reaches 60-100 m. The boiler main body 1 is hung from a sky beam 3 of the boiler frame 2 through a hanging portion 4 to release the thermal expansion downward.

Inside of boiler main body 1, a second and third superheater 5, a re-heater 6, a primary super-heater 7, an economizer 8 are placed; and the lower parts of the re-heater 6 and the economizer 8 are formed to be an eco-hopper 9. Multiple quantities of wind-boxes 10 are arranged to a furnace wall of the boiler main body 1; and a burner and a fuel pipe arrangement, a combustion air pipe arrangement are connected to the individual wind-box 10. A left area 11 of the boiler frame 2 is the area where coal bunker is placed. The lower area of eco-hopper 9 is assumed a cage part 12, and this cage part 12 is constructed as by floors 13 (13A, 13B, 13C, and 13D) of the plural floor levels.

In construction of the boiler, by building the boiler frame 2 first, while hanging and attaching various components and devices through the hanging portion 4 from the upper portion to the lower portion one after another, the boiler main body is formed.

The re-heater 6, the primary super-heater 7, the economizer 8, and the eco-hopper 9 forming the right side of boiler main body 1 are carried in to the ground of the cage part 12 in a shape of a block or unit for the working efficiency. A lifting device such as a jack or a winch is used, so that each of the blocks/units is lifted to set position and installed. In doing so, when there is any floor 13 in the cage part 12, the floor 13 will block up the route of the block of each components and devices and becomes the obstacle of lifting operation.

Because of this reason, the general method of securing the lifting route of each apparatus block is adopted without attaching any floor 13 within the cage part 12, till the installation of each equipment such as the re-heater 6, the primary superheater 7, the economizer 8, and the eco-hopper 9 is completed. And after the installation of the each equipment was completed, floors 13 (13A, 13B, 13C, and 13D) are built sequentially.

However, when the floors 13 are built by such a general method, the upper portion of the cage part 12 is occupied and closed by the eco-hopper 9. Because of this reason, there are problems that arise the efficiency deteriorates when importing and lifting various components of floors 13 by utilizing the crane since the eco-hopper 9 becomes the obstacle of the lifting operation.

On the other hand, the adoption of a block method of construction for the construction of boiler housing is receiving popular attention in recent years, for reducing both the construction cost and schedule.

An example of the block method of construction is disclosed in the Japanese Patent Number 2,932,818. In this block method of construction columns, girders, braces, middle beams, small beams, floor joists, plunk gratings, a handrail are assembled in a pre-fabrication shop in each predetermined block unit; and the blocks are piled up while they are lifting with a crane in construction field.

According to the block method of construction such as these, the assembling of the block can be performed in the pre-fabrication shop where the good environment condition. Also, there has been a significant reduction of costs and in terms of construction. These elements can be achieved because the assembling of the blocks at the construction site can be taken place at the same time in parallel, by setting the order of production of the block from the low-rise floor to the high-rise floor.

However, if a block method of construction described in the Japanese Patent Number 2,932,818 is applied to construction of the floors 13 after the installation of the completion of the eco-hopper 9 as described above, the eco-hopper 9 will still continue to be an obstacle. As a result, the lifting of huge blocks with the crane becomes more difficult; and the introduction of the block method of construction becomes practically impossible.

SUMMARY OF THE INVENTION

The objective of the present invention is to mend the prior-art problems, by making the erection of the boiler cage floors more readily even after the installation of the eco-hopper, which is to provide the construction method of the boiler cage part floors that can reduce the construction cost and the shorten the construction period.

In order to accomplish the objective, a method of constructing the boiler cage floors according to the present invention is a method of building multiple quantities of floors in the boiler cage part, which a floor for each of the floors is built on a lifting frame put on the ground, after the above floor is jacked up together with the lifting frame and connected to the designated floor level, the lifting frame which freed from the floor is jacked down and return to the ground, and repeat the sequence to build the floors from upper floor to lower floor in turn.

As explained, the floor is built on a lifting frame put on the ground, the above floor is jacked up together with the lifting frame and attached to the designated floor level, and the floors are built by repeating the sequence from upper floor to lower floor in turn, the assemble operation is performed safely and efficiently on the ground.

Also, in the situation where the use of the crane is difficult after the installation of the eco-hopper which is an upper structure of the boiler cage part completed, a floor block can be attached still easily, and reduction of the building cost and shortening for the term of works can be achieved.

In the above method, the lifting frame is assumed in a plane U-shaped type, it is desirable to reinforce the lifting frame with the beam member of the floor built. Also, it is desirable to install plural of columns stood on the lifting frame, and to build an above floor through these columns. As a lifting frame is made in a plane U-shaped type, authorized personnel and service vehicles can easily access in and out from an open side of the U-shaped type.

Additionally, the efficient floor building operation can be achieved by installing the floor member parts started from the back side of the U-shape to end at the open side of the U-shape sequentially. As for the lifting frame, the strength of disengaging part of the U-shaped type is reinforced indirectly by the beam member of a built floor.

Accordingly, even if the parts forming the lifting frame have a minimum section modulus or thin members are used, the lifting frame is strong enough against the suspension loads. It should be noted that the level adjustment is easy when there is an irregularity in the underside of the floor as the floor is built on the lifting frame through the columns.

Furthermore, it is desirable to form a jacking up mechanism with multiple quantities of jacks installed at the top portion of the boiler cage part. When the plural jacks are a hydrostatic drive-type jacks, it is desirable that synchronizing control of feeding oil to each jack from a common hydraulic pump. It is also desirable to place a level sensor on the floor so that the synchronizing control of the jacks is achieved accurately based upon the output signal of the level sensor.

Through the present invention, the economical and reliable construction of the floors can be realized hereby. When the floors are lifted, a part of each floor is cut (a notch portion or a through hole) so as to secure the passage lines of the hanging cables from the plural jacks respectively. After all floors are attached to designated floor position, and having removed the connection with the jacks, the part of each floor which is cut (the notch portion) is filled in to a normal usable condition.

Moreover, the method of constructing the boiler cage part floor according to the present invention is characterized by performing the construction of the floors after the installation of the eco-hopper located upper portion the boiler cage part.

BRIEF DESCRIPTION OF THE DRAWINGS

FIG. 1 is a side view illustrating a main architecture of large-scale boiler for thermal power plant performing the present invention just before that.

DETAILED DESCRIPTION OF THE PREFERRED EMBODIMENTS

The embodiments of the present invention are described below with reference to the accompanying drawings.

Figure 1:
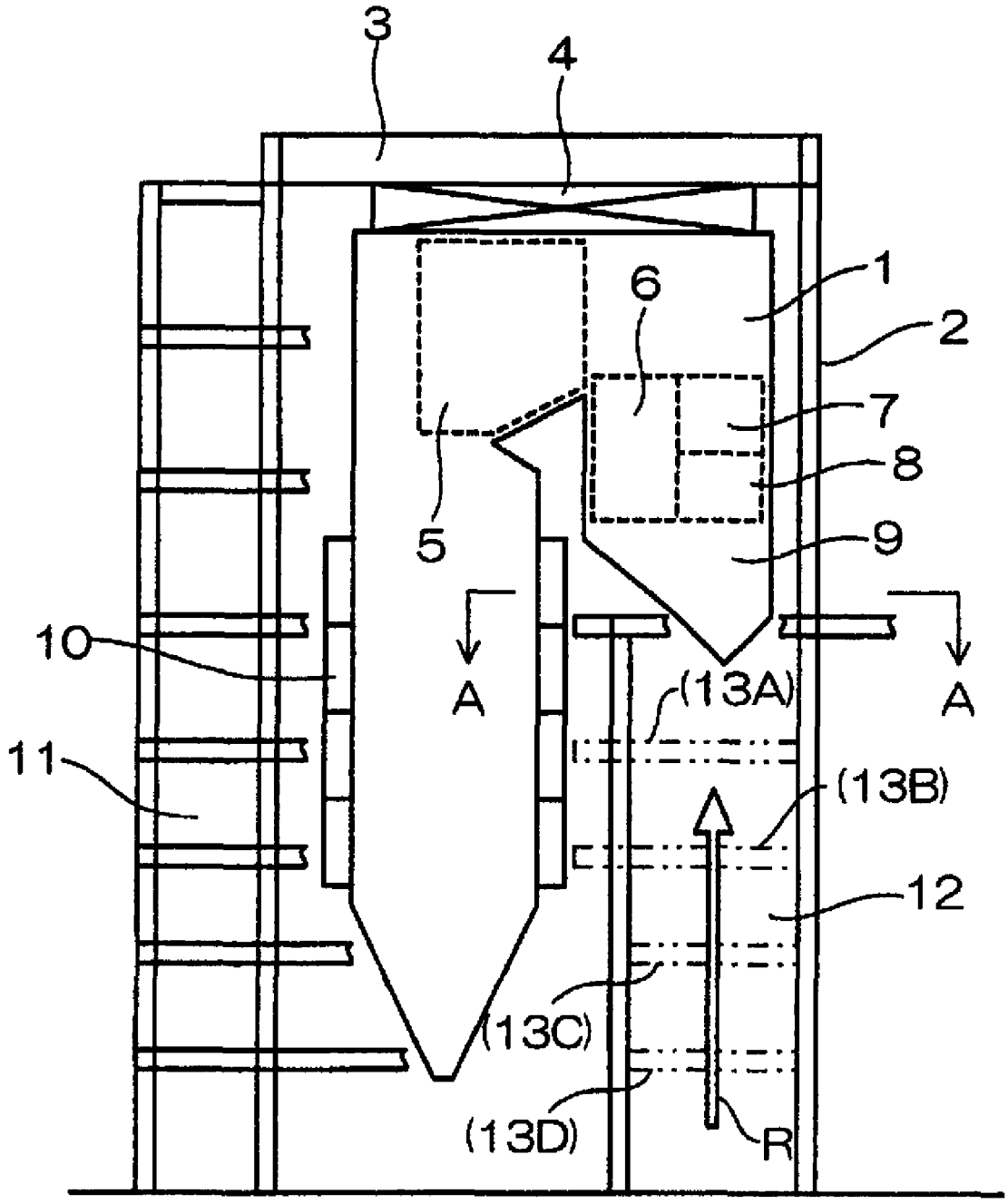

FIG. 1 is the side view which illustrated main architecture of a large-scale boiler for thermal power plant just before the implementation of the present invention. A Boiler main body 1 is hung from a sky beam 3 of a boiler frame 2 through hanging portion 4.

Inside of boiler main body 1, a second and third super-heater 5, a reheater 6, a primary super-heater 7, an economizer 8 are placed; and the lower parts of the re-heater 6 and the economizer 8 are formed to be an eco-hopper 9. Plural of wind boxes 10 are arranged to a furnace wall of the boiler main body 1. A left area 11 of the boiler frame 2 is the area where coal bunker is positioned.

The area below the eco-hopper 9 is assumed as a cage part 12. Until installation of various equipments such as a re-heater 6, a primary super-heater 7, a economizer 8, and an eco-hopper 9 are completed, a lifting root R of the each equipment block is kept clear without attaching a floor to the cage part 12.

And after the installation of the each equipment is completed, multiple levels of floors 13 (13A, 13B, 13C, and 13D) are built in a position shown with a 2 dotted line in the cage part 12.

Figure 2:
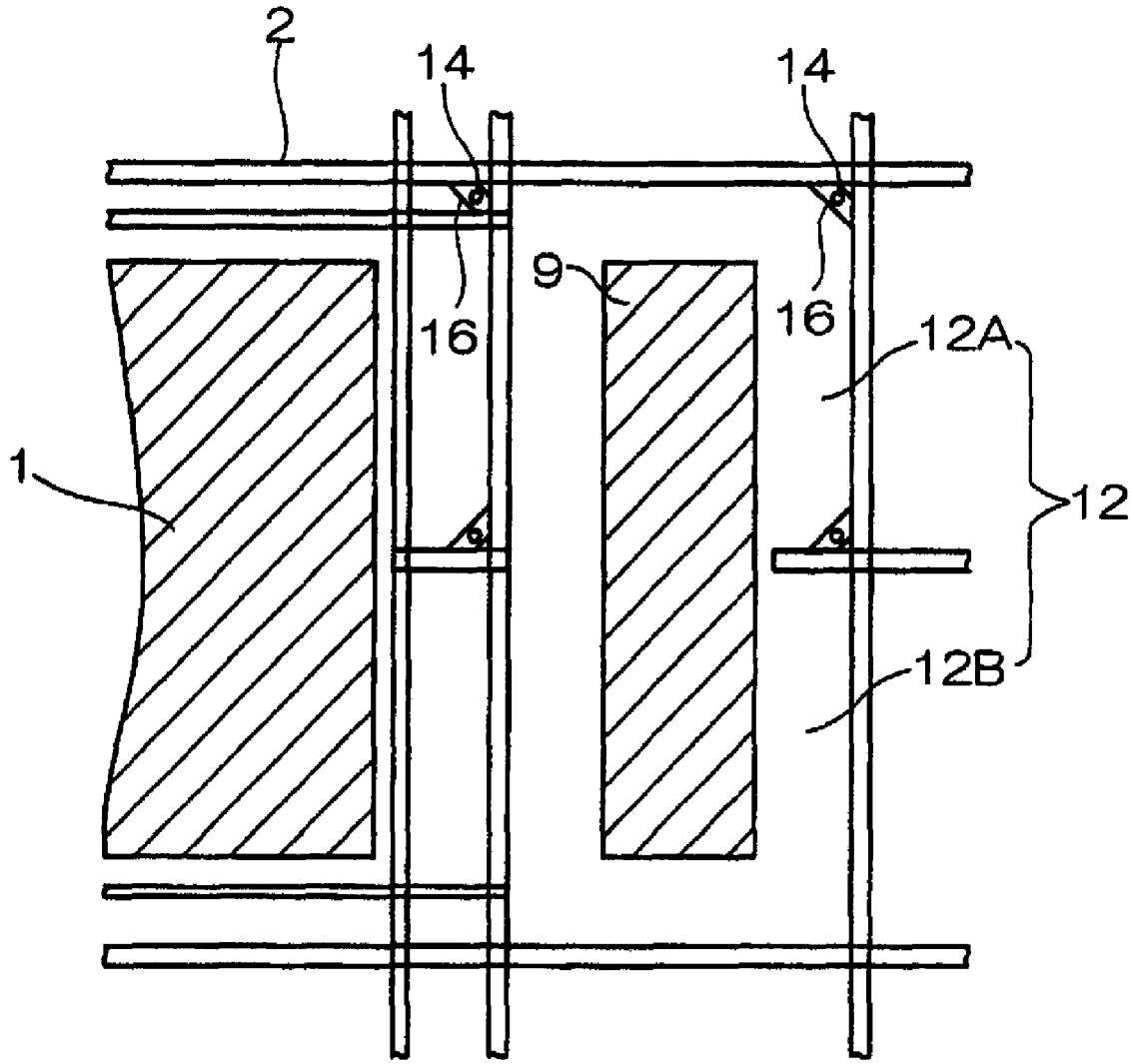
FIG. 2 is an A-A sectional plane view of FIG. 1.

FIG. 2 is an A-A sectional plane view of FIG. 1. The cage part 12 is partitioned in the first area 12A and the second area 12B. At first, as a preparation to build floors 13 to the first area 12A, jacks 14 are installed in four top corners of the first area 12A.

In other words, a jack base 16 is provided temporarily in each of four top corners; and a jack 14 is set to this jack base 16. The jack 14 is the center-hole type jack, and it lifts up and down the mid-ship part of the main body with a suspension cable by hydraulic pressure activation mechanism.

Figure 3:
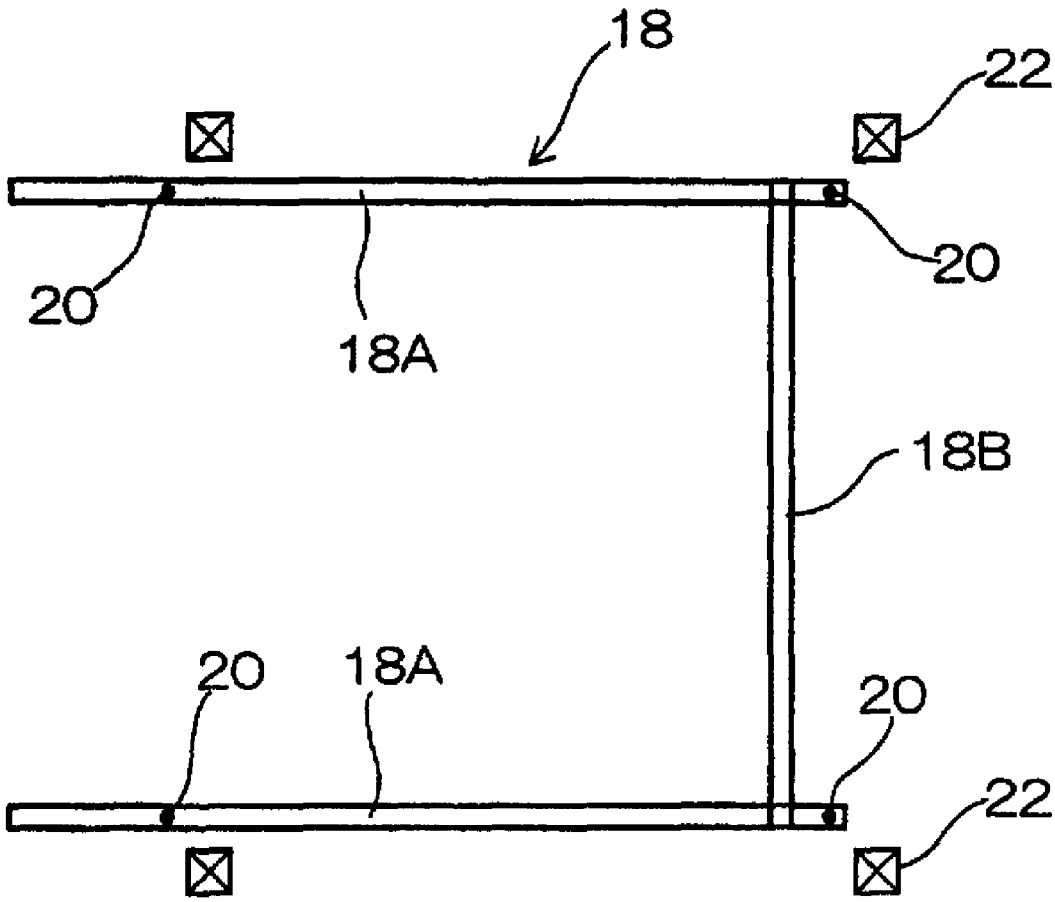
FIG. 3 is a plane view of the lifting frame.

FIG. 3 is a plane view of the lifting frame. A lifting frame 18 is formed with two cross members 18A and one bottom member 18B of the H mould steel with a plane U-shaped type construction (shifted by 90 degrees in the drawing). It is put on the ground, and one floor is built on the lifting frame 18. Lifting lugs 20 engaging with suspension cables of jacks 14 are attached to the both ends of two sides of opposed cross members 18A of lifting frame 18. The reference numbers 22 shown in FIG. 3 represents four columns defining the first area 12A. When lifting frame 18 is placed at the position displayed in the drawing, the position of lifting lugs 20 are set so that cores of the lifting lugs 20 agree with the centers of jacks 14.

Figure 4:
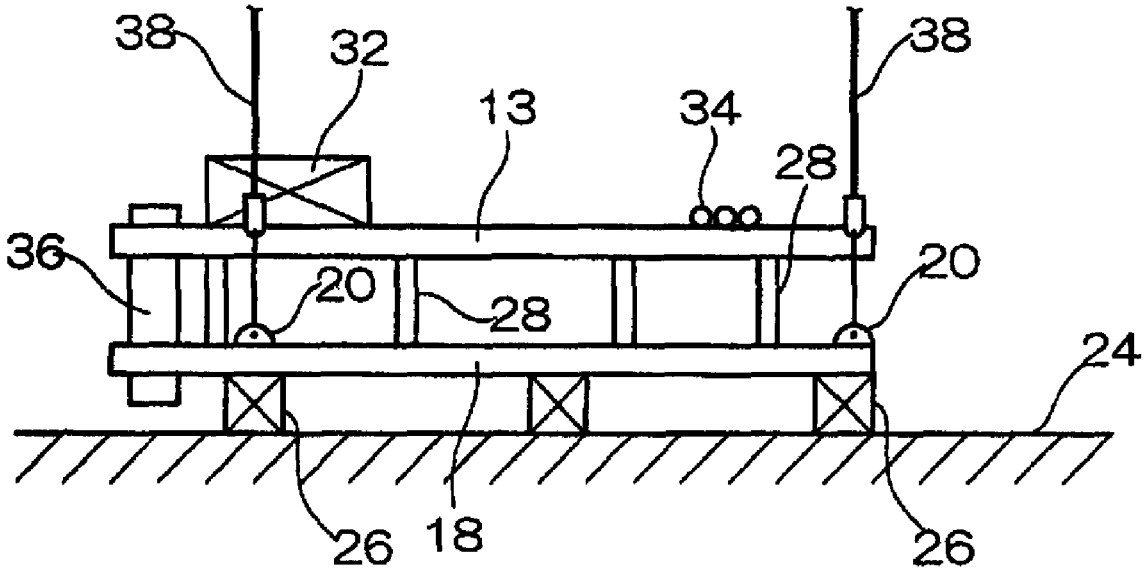
FIG. 4 is a side view illustrating the situation where a floor is built on a lifting frame.
Figure 5:
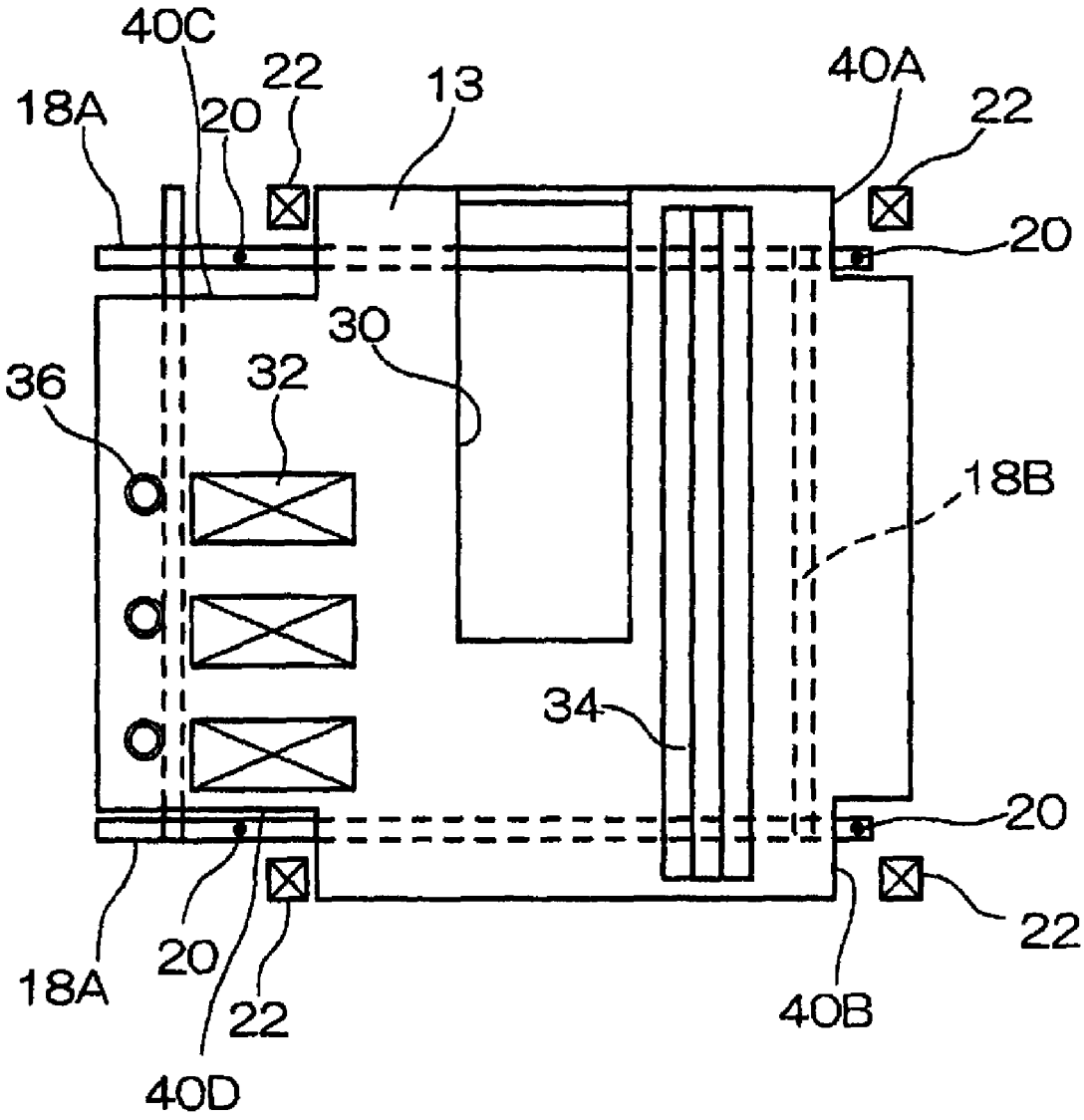
FIG. 5 is a plane view of FIG. 4.

FIG. 4 is a side view illustrating the situation where a floor is built on a lifting frame, and FIG. 5 is its plane view. Raising members 26 are posted in the ground 24, and the lifting frame 18 is put on the raising members 26. Multiple quantities of columns 28 are posted on the lifting frame 18 next. The floor 13 is built on the lifting frame 18 through these columns 28. An opening 30 is established in the necessary location in floor 13; a handrail and a stairway are also attached. Also, small equipment 32 such as a pipe arrangement 34, a duct 36 placed above and below the floor 13 are attached as necessary. It should be noted that the lifting lug 20 of the lifting frame 18 is exposed from floor 13 so that it can engage with the suspension cable 38 hanging down from the jack 14.

As a lifting frame is made in a plane U-shaped type, authorized personnel and service vehicles can easily access in and out from an open side of the U-shaped type. Thus, the efficient building operation for the floor 13 can be achieved by installing the floor member parts start from the back side of the U-shape and end at the open side of the U-shape sequentially.

It should be noted that the level adjustment is easy when there is an irregularity in the underside of the floor 13 as the floor 13 is built on the lifting frame 18 through the columns 28. It should be notes that the adjustment level can easily be manipulated when there is an irregularity in the underside of the floor 13, as the floor 13 is built on the lifting frame 18 through the columns 28.

Furthermore, the strength of disengaging part of the U-shaped type lifting frame 18 is reinforced indirectly by the beam member of a built floor 18. Thus, even if the cross members 18A and the bottom member 18B forming the lifting frame 18 have a minimum section modulus or thin members are used, the lifting frame is strong enough against the suspension loads.

A block of single floor 13 is built on the lifting frame 18 on ground; and each floor is jacked up with the lifting frame 18 and installed to the designated position.

In other words, after having locked the lower end of the each suspension cable 38 that is hanging down from four jacks 14 stationed on a top of first area 12A to a lifting lug 20 of the lifting frame 18, the four jacks 14 is operated in synchronism for jacking up the floor 13 together with the lifting frame 18.

It is desirable that a horizontal sensor is placed on the floor 13, and the synchronizing control of the four jacks 14 are conducted with the output signal of the level sensor so that the floor 13 keeps its level. Also, when jack 14 is a hydrostatic drive-type jack, it is desirable that synchronizing control feeds oil from the common hydraulic pump (not shown) so as to make the jack stroke of each jack 14 become same as other jacks 14.

Figure 6:
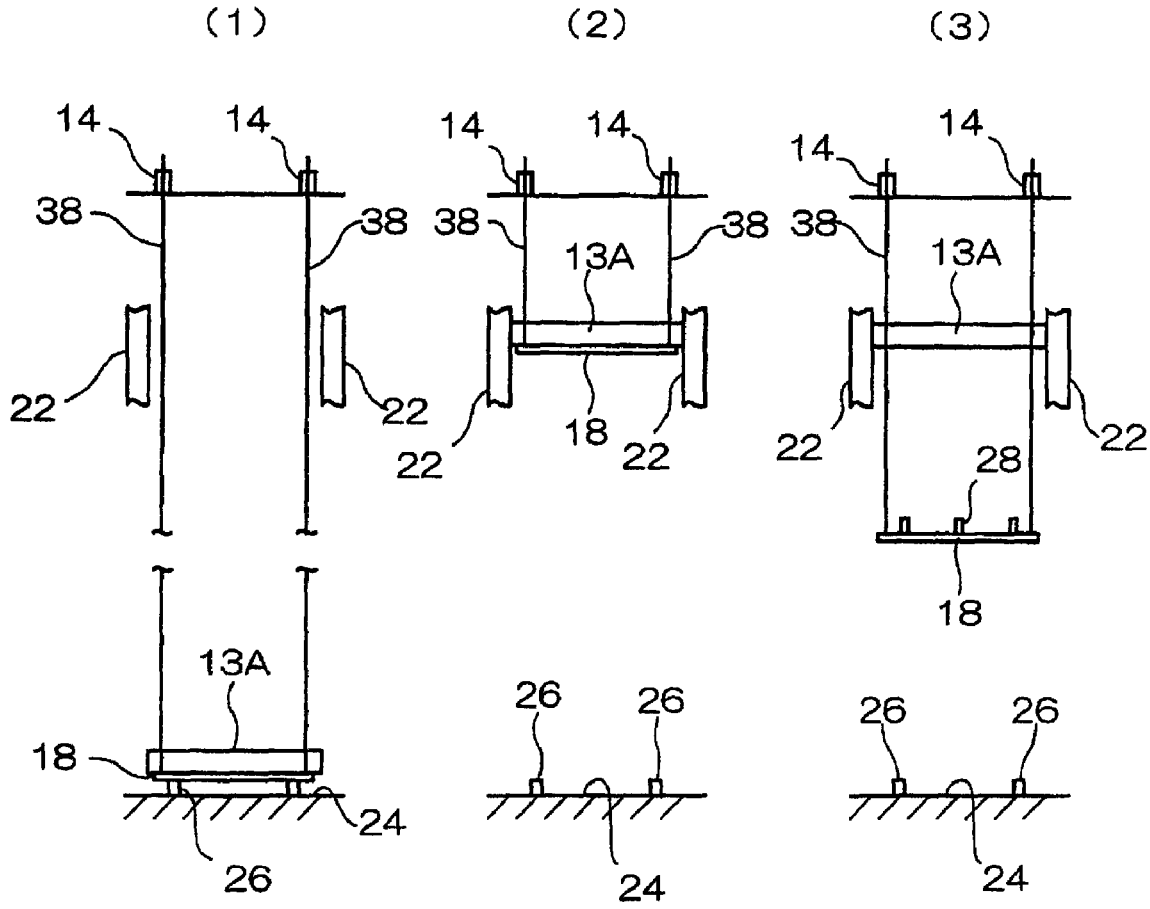
FIG. 6 is an explanatory drawing showing installation situation of floor 13A.

FIG. 6 is the explanatory drawing which shows initial situation of the floor installation, and it shows installation situation of highest floor 13A of the first area 12A shown in FIG. 2.

Initially, the lifting frame 18 is engaged with the suspension cable 38 hanging down from the jack 14 as illustrated in FIG. 6 (1); and the floor 13A is built on the lifting frame 18. As shown in FIG. 6 (2), the floor 13A is raised and the frame 18 is jack to the height of its designated floor, then the floor 13A is attached to column 22.

Figure 7:
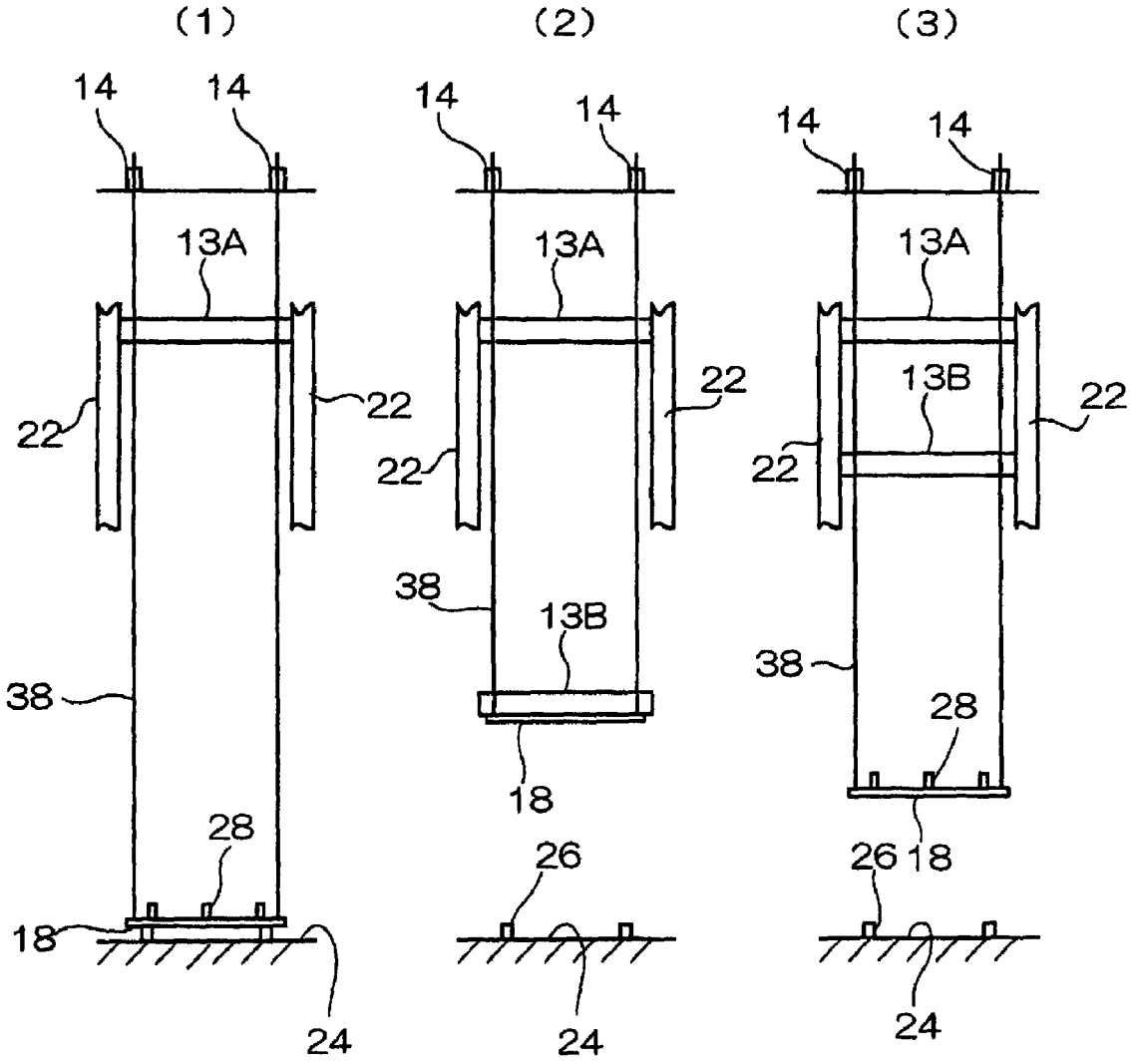
FIG. 7 is an explanatory drawing showing installation situation of floor 13B.

When the installation of floor 13A is completed, the lifting frame 18 is freed from the floor 13A and jacked down as illustrated in FIG. 6 (3). In doing so, the column 28 is also jacked down together with the lifting frame 18. FIG. 7 is the explanatory drawing which showed the next situation of the floor installation. Following the situation shown in FIG. 6 (3), the installation situation of floor 13B which is lower floor of floor 13A is shown.

At first the lifting frame 18 in the empty condition is returned to the ground as shown in FIG. 7 (1) through the jacking down operation, floor 13B will be built on this lifting frame 18.

Next, as shown in FIG. 7 (2), the floor 13B is lifted with the lifting frame 18. After having attached the jacked up floor 13B to the column 22 at the designated floor height, the lifting frame 18 which separated floor 13A will be jacked down as shown in FIG. 7 (3). In the same way, the sequence of operation will be repeated to assemble the floor 13 on the lifting frame 18, to jack up the frame 18, to attach the floor 13 to the designated floor height, to jack down the disengaged lifting flame 18, so as to build each floor from a higher floor to a lower floor.

It should be noted that it is necessary to secure the passage line of each suspension cable 38 hanging down from four jacks 14 respectively through the jack-up operation. For achieving this goal, each floor 13 is assembled and jacked up with partial cut-aways 40A, 40B, 40C and 40D so as to secure the passage lines of the suspension cables 38 as shown in FIG. 5.

And after all floors 13 are attached to the designated floor height, and having removed four jacks 14, partial cut-aways 40A, 40B, 40C and 40D of each floor 13 are put back to normal condition.

Figure 8:
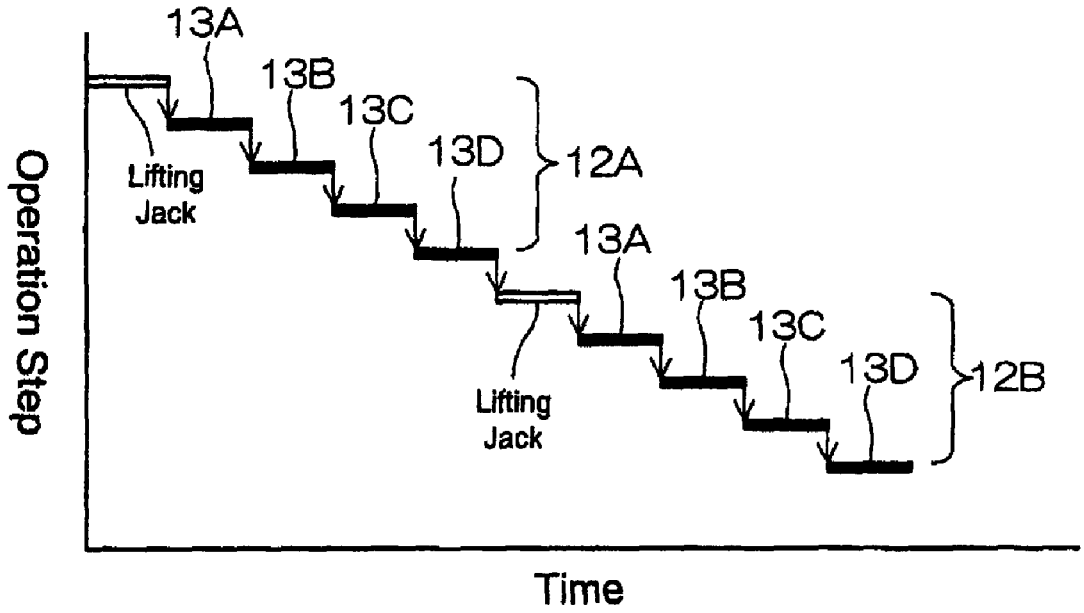
FIG. 8 is a process drawing showing an example of construction process of the boiler cage part floor.
Figure 9:
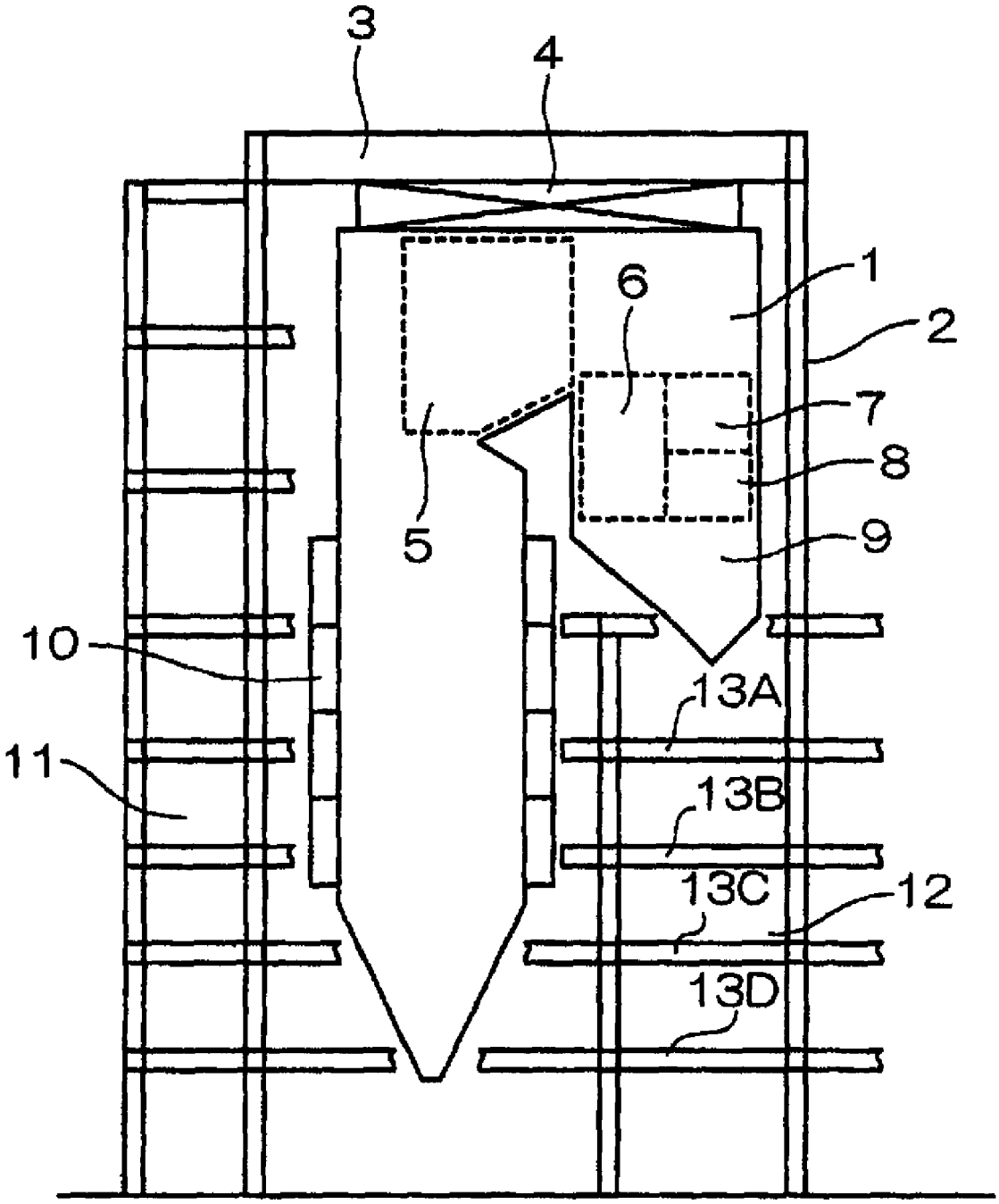
FIG. 9 is a side view showing an example of architecture of large-scale boiler for a thermal power plant.

FIG. 8 is the process drawing which exemplified the construction process of the boiler cage part floor by above mentioned method.

At first, a jack mechanism is set to a top of the first area 12A among the cage part 12 as indicated in FIG. 2. A floor of plural floors in the first area 12A is built from the upper floor in order of the floor 13A, the floor 13B, floor 13C, and the floor 13D; that is from the highest floor to the lower.

When the construction of the floor at first area 12A is finished, a jack mechanism is moved and relocated to a top of the second area 12B.

And a floor of plural floors in the second area 12B is built from the upper floor in order of the floor 13A, the floor 13B, the floor 13C and the floor 13D; that is from the highest floor to the lower floor. According to the construction method of the boiler cage part floor of the present embodiment, even in the condition where the usage of the crane after installation of the eco-hopper 9 is in a difficult situation, floors 13 in a shape of blocks can be attached easily, which contributes the reduction of the construction cost and the shortening the construction period.

In the above embodiment, it is described that the first part of the cage is divided into the first area 12A and the second area 12B, and the respective floors 13 are built separately. However, as for the present invention, by the entire floor may be built as a whole, without being limited to the embodiment.

Additionally, it is described in the embodiment that each floor 13 is built on lifting frame 18 through multiple columns 28. However, according to the present invention, the floor 13 may be built on the lifting frame 18 directly without being limited to the embodiment.

Furthermore, as a jack mechanism, the usage of the center hole type jack 14 is explained. However, the jack mechanism to be used in the present invention can be various measures without being limited to it; for example, a mechanism using the winch mechanism is also included in the scope of present invention.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

The invention claimed is:

1. A method of building a floor for boiler cage comprising the steps of:

building a single floor onto a lifting frame positioned on the ground, the whole lifting frame being positioned below the single floor;

jacking-up the floor together with the lifting frame then fixing the floor to a designated floor height; and detaching the floor from the lifting frame then jacking-down the lifting frame to the ground;

wherein multiple levels of floors are built from the higher most floor to the lower most floor by repeating the building, jacking-up and down steps.

2. The method of building a floor as claimed in claim 1, wherein the lifting frame is formed in a U-shape, and the strength of the lifting frame is reinforced by a beam member of the floor.

3. The method of building a floor as claimed in claim 1, further including multiple quantities of columns posted on the lifting frame, and the floor is built on the lifting frame through the columns.

4. The method of building a floor as mentioned in claim 1, wherein a jacking mechanism is formed with multiple quantities of jacks installed at the top portion of the boiler cage part.

5. The method of building a floor as in claim 4, wherein the jack is of a hydrostatic drive-type, and a synchronizing control feeds oil from a common hydraulic pump so as to make the stroke of each jack identical as that of other jacks.

6. The method of building a floor as claimed in claim 4, wherein a level sensor on the floor is installed so that the synchronizing control of the jacks is accurately achieved based upon the output signal of the level sensor.

7. The method of building a floor as claimed in claim 6, wherein the jack is of a hydrostatic drive-type, and a synchronizing control feeds oil from a common hydraulic pump so as to make the stroke of each jack identical as that of other jacks.

8. The method of building a floor as claimed in claim 7, wherein a part of each floor is cut or formed through a notch portion or a through hole so as to secure the passage lines of the hanging cables from the plural jacks respectively when the floors are lifted; and after all floors are attached to designated floor position, and having removed the connection with the jacks, the part of each floor which is cut or formed through a notch portion or through hole is filled in to perform a normal usable condition.

9. The method of building a floor as claimed in claim 4, wherein a part of each floor is cut or formed through a notch portion or a through hole so as to secure the passage lines of the hanging cables from the plural jacks respectively when the floors are lifted; and after all floors are attached to designated floor position, and having removed the connection with the jacks, the part of each floor which is cut or formed through a notch portion or through hole is filled in to perform a normal usable condition.

10. The method of building a floor as claimed in claim 1, wherein construction of the floors is performed after installation of an eco-hopper located in the upper portion of the aforementioned part of the boiler cage.

* * * * *